US005975447A

United States Patent [19]

Brusseau

[11] Patent Number: 5,975,447

[45] Date of Patent: Nov. 2, 1999

[54] CAKED GRAIN BREAKER

[76] Inventor: Willard Brusseau, HCR #1 Box 11, Osnabrock, N. Dak. 58269

[21] Appl. No.: 09/130,435

[22] Filed: Aug. 6, 1998

[51] Int. Cl.[6] ..... B02C 19/00

[52] U.S. Cl. ..... 241/95; 241/274

[58] Field of Search ..... 241/95, 274

[56] References Cited

U.S. PATENT DOCUMENTS

| | | | |
|---|---|---|---|
| 4,467,715 | 8/1984 | Bunger | 100/45 |
| 4,737,062 | 4/1988 | Mathewes | 414/288 |
| 5,013,430 | 5/1991 | Mileson | 210/159 |
| 5,074,996 | 12/1991 | Galanty et al. | 210/141 |
| 5,339,961 | 8/1994 | Mayhak | 209/3 |
| 5,472,147 | 12/1995 | Doppstadt | 241/88.4 |

*Primary Examiner*—Joseph J. Hail, III
*Assistant Examiner*—Dermoh J. Cooke

[57] ABSTRACT

A caked grain breaker for separating caked grain particles in a storage bin. The device includes a top grate for positioning above the opening in the bin floor. The top grate has a plurality of apertures therethrough for permitting passage of grain through the top grate. A plurality of spikes for breaking apart caked grain are upwardly extended from the top grate. A plurality of telescopic legs are downwardly depended from the top grate for supporting the top grate above the bin floor. A fluidic piston-cylinder actuator is provided in each of the legs so that each fluidic piston-cylinder actuator extends its associated leg when the fluidic piston-cylinder is extended.

9 Claims, 2 Drawing Sheets

CAKED GRAIN BREAKER

BACKGROUND OF THE INVENTION

1. Field of the Invention

The present invention relates to devices for breaking apart caked grain and more particularly pertains to a new caked grain breaker for separating caked grain particles in a storage bin.

2. Description of the Prior Art

The use of devices for breaking apart caked grain is known in the prior art. More specifically, devices for breaking apart caked grain heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,074,478; U.S. Pat. No. 4,313,706; U.S. Pat. No. 4,183,706; U.S. Pat. No. 4,565,307; U.S. Pat. No. 4,618,304; and U.S. Pat. No. 4,995,756.

While these devices fulfill their respective, particular objectives and requirements, the aforementioned patents do not disclose a new caked grain breaker. The inventive device includes a top grate for positioning above the opening in the bin floor. The top grate has a plurality of apertures therethrough for permitting passage of grain through the top grate. A plurality of spikes for breaking apart caked grain are upwardly extended from the top grate. A plurality of telescopic legs are downwardly depended from the top grate for supporting the top grate above the bin floor. A fluidic piston-cylinder actuator is provided in each of the legs so that each fluidic piston-cylinder actuator extends its associated leg when the fluidic piston-cylinder is extended.

In these respects, the caked grain breaker according to the present invention substantially departs from the conventional concepts and designs of the prior art, and in so doing provides an apparatus primarily developed for the purpose of separating caked grain particles in a storage bin.

SUMMARY OF THE INVENTION

In view of the foregoing disadvantages inherent in the known types of devices for breaking apart caked grain now present in the prior art, the present invention provides a new caked grain breaker construction wherein the same can be utilized for separating caked grain particles in a storage bin.

The general purpose of the present invention, which will be described subsequently in greater detail, is to provide a new caked grain breaker apparatus and method which has many of the advantages of the devices for breaking apart caked grain mentioned heretofore and many novel features that result in a new caked grain breaker which is not anticipated, rendered obvious, suggested, or even implied by any of the prior art devices for breaking apart caked grain, either alone or in any combination thereof.

To attain this, the present invention generally comprises a top grate for positioning above the opening in the bin floor. The top grate has a plurality of apertures therethrough for permitting passage of grain through the top grate. A plurality of spikes for breaking apart caked grain are upwardly extended from the top grate. A plurality of telescopic legs are downwardly depended from the top grate for supporting the top grate above the bin floor. A fluidic piston-cylinder actuator is provided in each of the legs so that each fluidic piston-cylinder actuator extends its associated leg when the fluidic piston-cylinder is extended.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new caked grain breaker apparatus and method which has many of the advantages of the devices for breaking apart caked grain mentioned heretofore and many novel features that result in a new caked grain breaker which is not anticipated, rendered obvious, suggested, or even implied by any of the prior art devices for breaking apart caked grain, either alone or in any combination thereof.

It is another object of the present invention to provide a new caked grain breaker which may be easily and efficiently manufactured and marketed.

It is a further object of the present invention to provide a new caked grain breaker which is of a durable and reliable construction.

An even further object of the present invention is to provide a new caked grain breaker which is susceptible of a low cost of manufacture with regard to both materials and labor, and which accordingly is then susceptible of low prices of sale to the consuming public, thereby making such caked grain breaker economically available to the buying public.

Still yet another object of the present invention is to provide a new caked grain breaker which provides in the apparatuses and methods of the prior art some of the advantages thereof, while simultaneously overcoming some of the disadvantages normally associated therewith.

Still another object of the present invention is to provide a new caked grain breaker for separating caked grain particles in a storage bin.

Yet another object of the present invention is to provide a new caked grain breaker which includes a top grate for positioning above the opening in the bin floor. The top grate has a plurality of apertures therethrough for permitting passage of grain through the top grate. A plurality of spikes for breaking apart caked grain are upwardly extended from the top grate. A plurality of telescopic legs are downwardly depended from the top grate for supporting the top grate above the bin floor. A fluidic piston-cylinder actuator is provided in each of the legs so that each fluidic piston-cylinder actuator extends its associated leg when the fluidic piston-cylinder is extended.

Still yet another object of the present invention is to provide a new caked grain breaker that breaks apart caked grain in a storage bin so that the grain may be passed out of the storage bin by an auger at the bottom of the storage bin.

Even still another object of the present invention is to provide a new caked grain breaker that provides a way for breaking apart caked grain without having the user enter the storage thereby reducing the risk of injury to the user from large amounts of grain (such as from a cave in of the caked grain) falling on the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
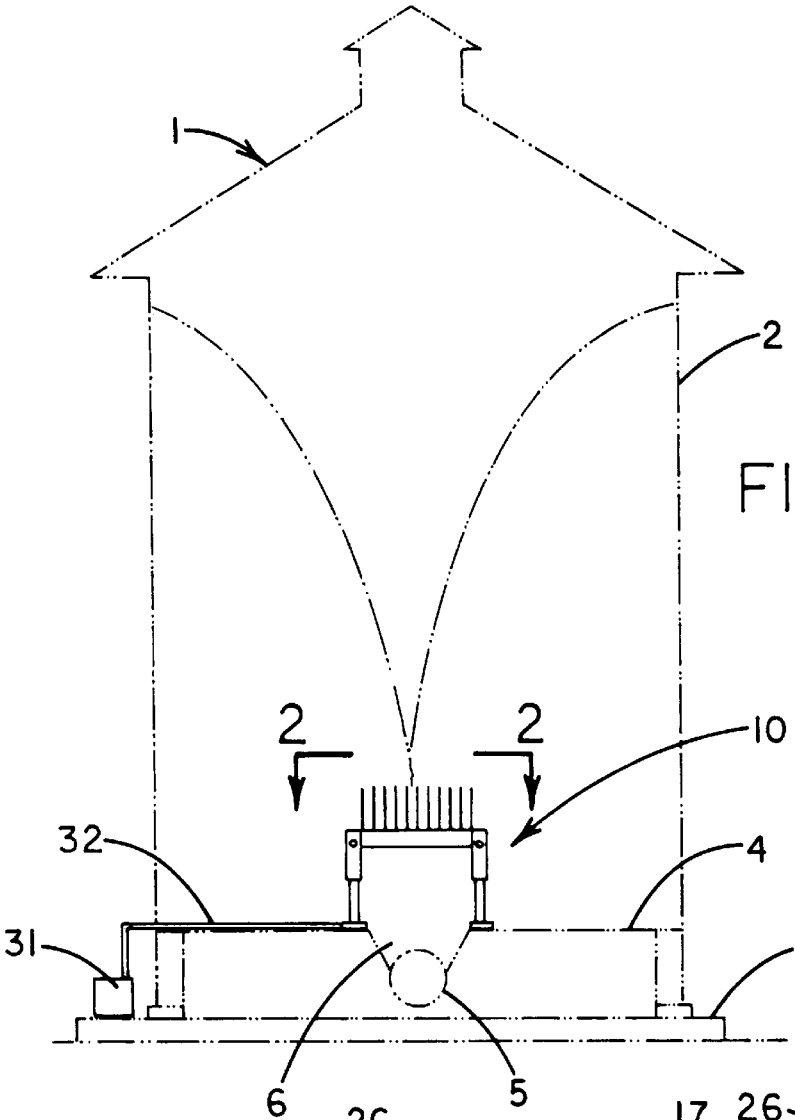
FIG. 1 is a schematic side view of a new caked grain breaker in use according to the present invention.
Figure 2:
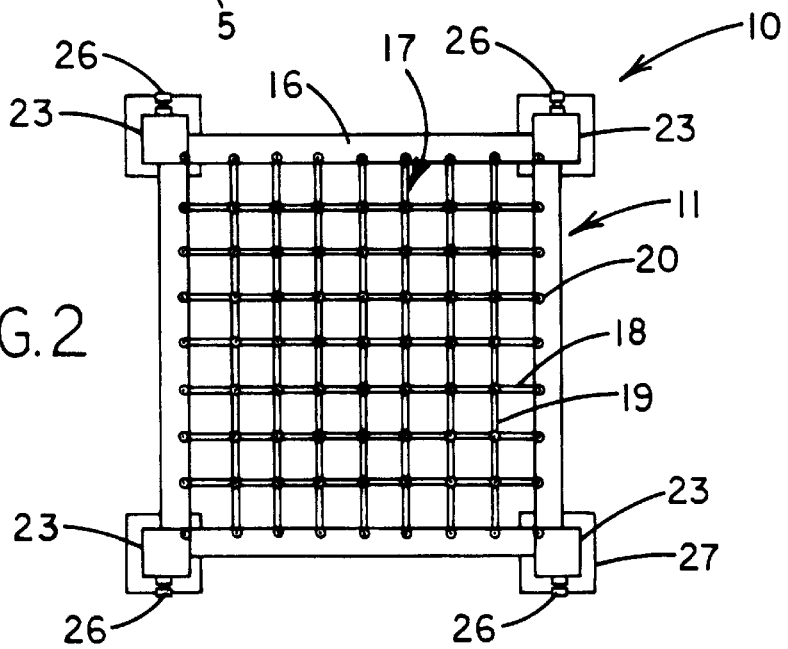
FIG. 2 is a schematic top view of the present invention.
Figure 3:
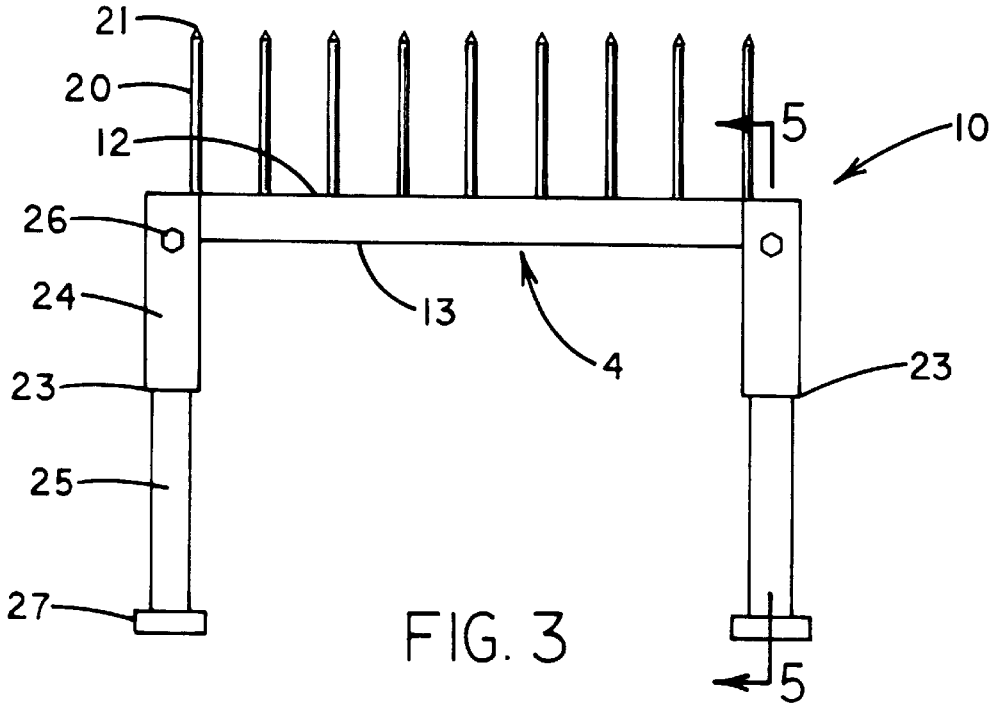
FIG. 3 is a schematic side view of the present invention.
Figure 4:
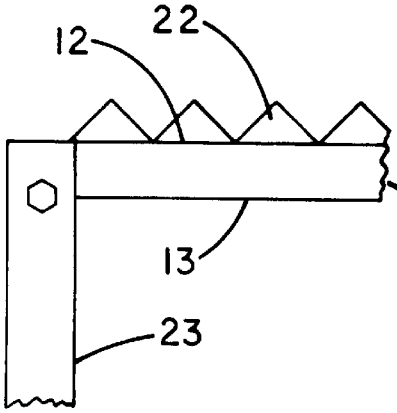
FIG. 4 is a schematic partial view of an optional preferred embodiment of the present invention.
Figure 5:
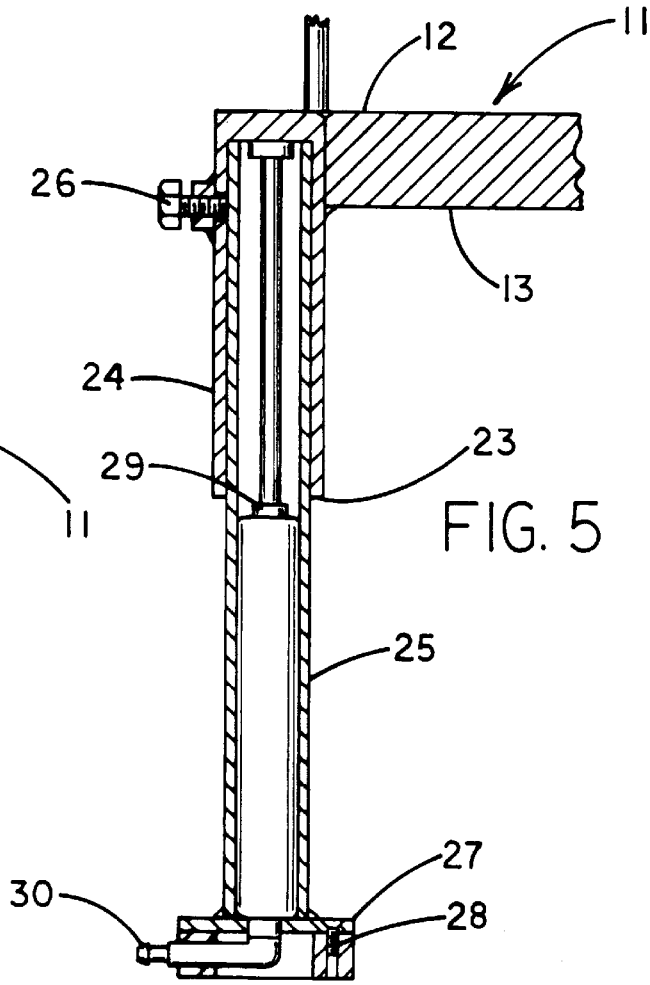
FIG. 5 is a schematic cross sectional view of a leg of the present invention taken from line 5—5 on FIG. 3.

With reference now to the drawings, and in particular to FIGS. 1 through 5 thereof, a new caked grain breaker embodying the principles and concepts of the present invention and generally designated by the reference numeral 10 will be described.

As best illustrated in FIGS. 1 through 5, the caked grain breaker 10 generally comprises a top grate 11 for positioning above the opening 6 in the bin floor 4. The top grate 11 has a plurality of apertures 15 therethrough for permitting passage of grain through the top grate 11. A plurality of spikes 20 for breaking apart caked grain are upwardly extended from the top grate 11. A plurality of telescopic legs 23 are downwardly depended from the top grate 11 for supporting the top grate 11 above the bin floor 4. A fluidic piston-cylinder actuator 29 is provided in each of the legs 23 so that each fluidic piston-cylinder actuator 29 extends its associated leg 23 when the fluidic piston-cylinder is extended.

In use, the device 10 is designed for breaking apart caked grain in storage bin 1 has a housing 2, a base floor 3, a bin floor 4 for supporting grain in the storage bin 1 spaced above the base floor 3. A conveyor 5 such as an auger is located between the base floor 3 and the bin floor 4 and extends across the storage bin 1 and through the housing 2 for discharging grain from the storage bin 1. An opening 6 through the bin floor 4 is positioned above the conveyor 5 for feeding grain in the storage bin 1 to the conveyor 5.

Specifically, the device 10 includes a top grate 11 for positioning above the opening 6 in the bin floor 4 (ideally about 28 inches) above the opening 6. The top grate 11 has generally horizontal upper and lower faces, an outer perimeter 14. The top grate 11 also has a plurality of apertures 15 therethrough between the upper and lower faces of the top grate 11 for permitting passage of grain through the top grate 11. The upper and lower faces are each generally planar and preferably lie in generally parallel planes. The outer perimeter 14 of the top grate 11 is preferably generally rectangular and has a first pair of opposite sides, a second pair of opposite sides extending between the first pair of opposite sides of the outer perimeter 14 of the grate, and a plurality of corners. The top grate 11 has a length defined between the first pair of opposite sides and a width defined between the second pair of opposite sides. Preferably, the length and the width of the top grate 11 are of about equal dimensions. In an ideal illustrative embodiment, the length and the width of the top grate 11 are each about 28 inches.

The top grate 11 ideally comprises an outer frame 16 extending along the outer perimeter 14 of the top grate 11 and a central grating 17 defining the apertures 15 of the top grate 11. Each aperture 15 preferably has a generally rectangular configuration. The central grating 17 has a plurality of intersecting row rails 18 and column rails 19 which define the apertures 15 of the top grate 11 therebetween to form a generally rectangular grid of apertures 15 arranged in a plurality of rows and columns.

A plurality of generally vertical spikes 20 for breaking apart caked grain are upwardly extended from upper surface 12 of the top grate 11. Each of the spikes 20 has a pointed upper tip 21 and a longitudinal axis preferably extending generally perpendicular to the upper surface 12 of the top grate 11. The spikes 20 are preferably arranged in a grid like fashion on the top grate 11 such that each spike 20 is located at an intersection between intersecting row and column rails 18,19. Optionally, especially for climates where freezing of caked grain is not a problem, a plurality of triangular teeth 22 may be upwardly extended from the upper surface 12 of the top grate 11 instead of the spikes. The teeth are preferably arranged in a similar fashion as the spikes 20 on the top grate 11.

A plurality of legs 23 downwardly depend from the top grate 11 for supporting the top grate 11 above the bin floor 4 with a leg 23 located adjacent each corner of the outer perimeter 14 of the top grate 11. The top end of each of the legs 23 is coupled to the top grate 11 and the bottom ends of the legs 23 are designed for resting on the bin floor 4. Each of the legs 23 has a longitudinal axis extending between the top and bottom ends of the respective leg 23. The longitudinal axes of the legs 23 are preferably extended in a generally vertical direction such that the legs 23 are generally perpendicular to the upper surface 12 of the top grate 11. The bottom end of each of the legs 23 preferably has a foot 27 for securing to the bin floor 4 preferably with a threaded fastener 28. Each of the legs 23 is telescopically extendible along their length and have upper and lower telescopic portions 24,25 in a telescopic relationship with one another. The lower portion 25 of each leg 23 is removable from the upper portion 24 to reduce the size of the device so that it may be easily installed and removed from the housing 2 of the storage bin 1. Each leg 23 has a threaded holding pin 26 located adjacent the top end of the respective leg 23 for helping hold the upper and lower portions 24,25 of the respective leg 23 together but not to tight to prevent the telescopic extension of the respective leg 23.

A fluidic piston-cylinder actuator 29 (air or hydraulic) is provided in each of the legs 23. Each fluidic piston-cylinder actuator 29 is extendable in a direction parallel to the longitudinal axis of the associated leg 23. In use, each fluidic piston-cylinder actuator 29 extends its associated leg 23 when the respective fluidic piston-cylinder is extended. Each fluidic piston-cylinder has a connector 30 for permitting fluidic connection to a fluid compressor 31 by a hose 32. Preferably, the connector 30 is located in the foot 27 of the associated leg 23 and extends out of the side of the foot 27. Each fluidic piston-cylinder actuator 29 preferably has its own conduit 32 to the compressor 31 to help ensure that each fluidic piston-cylinder actuator 29 receives fluid from the compressor 31. In use, the fluidic pistons are pulsed by a control valve in the compressor 31 so that each pulse extends lengths the legs 23 a predetermined distance (ideally about 4 inches) and then lets fluid piston-cylinder actuators 29 (and thereby the legs 23 as well) retract so that the top grate 11 and spikes 20 are raised and then lowered a comparable distance to break up caked grain above the top grate 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for breaking apart caked grain in storage bin having a housing, a base floor, a bin floor for supporting grain in the storage bin spaced above the base floor, a conveyor located between the base floor and the bin floor for discharging grain from the storage bin, and an opening through the bin floor for feeding grain in the storage bin to the conveyor, said device comprising:

a top grate for positioning above the opening in the bin floor, said top grate having upper and lower faces, and an outer perimeter, said upper and lower faces having a substantially horizontal orientation, a plurality of apertures extending through said top grate between said upper and lower faces for permitting passage of grain through said top grate;

a plurality of spikes for breaking apart caked grain located above the opening in the bin floor, said plurality of spikes extending upwardly from said upper surface of said top grate;

a plurality of legs downwardly depending from said top grate for supporting said top grate above the bin floor, said legs being adapted for positioning around the opening in the bin floor;

each of said legs having a longitudinal axis and being telescopically extendible; and an actuator being provided in each of said legs, each fluidic piston-cylinder actuator extending the associated leg for thrusting the plurality of spikes into any caked grain located above and adjacent to the opening in the bin floor.

2. The device of claim 1, wherein said upper and lower faces each are generally planar and lie in generally parallel planes.

3. The device of claim 1, wherein said outer perimeter of said top grate is generally rectangular and having a first pair of opposite sides, a second pair of opposite sides extending between said first pair of opposite sides of said outer perimeter of said grate, and a plurality of corners, a leg being located adjacent each corner.

4. The device of claim 3, wherein said top grate has a length defined between said first pair of opposite sides and a width defined between said second pair of opposite sides, wherein said length and said width of said top grate are of about equal dimensions, wherein said length and said width of said top grate are each about 28 inches.

5. The device of claim 1, wherein said top grate comprises an outer frame extending along said outer perimeter of said top grate and a central grating defining said apertures of said top grate, each aperture having a generally rectangular configuration, said central grating having a plurality of intersecting row rails and column rails defining said apertures of said top grate therebetween to form a generally rectangular grid of apertures arranged in a plurality of rows and columns.

6. The device of claim 5, wherein said spikes are arranged in a grid like fashion on said top grate such that each spike is located at an intersection between intersecting grid and row rails.

7. The device of claim 1, wherein each actuator comprises a fluidic piston-cylinder adapted for connection to a compressor.

8. A device for breaking apart caked grain in storage bin having a housing, a base floor, a bin floor for supporting grain in the storage bin spaced above the base floor, a conveyor located between the base floor and the bin floor for discharging grain from the storage bin, and an opening through the bin floor for feeding grain in the storage bin to the conveyor, said device comprising:

a top grate for positioning above the opening in the bin floor, said top grate having upper and lower faces, and an outer perimeter, said upper and lower faces having a substantially horizontal orientation, a plurality of apertures extending through said top grate between said upper and lower faces of said top grate for permitting passage of grain through said top grate;

said upper and lower faces each being generally planar and lying in generally parallel planes;

said outer perimeter of said top grate being generally rectangular and having a first pair of opposite sides, a second pair of opposite sides extending between said first pair of opposite sides of said outer perimeter of said grate, and a plurality of corners;

said top grate comprising an outer frame extending along said outer perimeter of said top grate and a central grating defining said apertures of said top grate;

each aperture having a generally rectangular configuration, said central grating having a plurality of intersecting row rails and column rails defining said apertures of said top grate therebetween to form a generally rectangular grid of apertures arranged in a plurality of rows and columns;

wherein said top grate has a length defined between said first pair of opposite sides and a width defined between said second pair of opposite sides, wherein said length and said width of said top grate are of about equal dimensions, wherein said length and said width of said top grate are each about 28 inches;

a plurality of spikes for breaking apart caked grain located above the opening in the bin floor, said plurality of spikes extending upwardly from said upper surface of said top grate, each of said spikes having a pointed upper tip and a longitudinal axis extending generally perpendicular to said upper surface of said top grate;

said spikes being arranged in a grid like fashion on said top grate such that each spike is located at an intersection between intersecting column and row rails;

a plurality of legs downwardly depending from said top grate for supporting said top grate above the bin floor, said legs being adapted for positioning around the opening in the bin floor, a leg being located adjacent each corner of said outer perimeter of said top grate;

each leg having top and bottom ends said top end of each of said legs being coupled to said top grate, said bottom ends of said legs being for resting on the bin floor;

each of said legs having a longitudinal axis extending between said top and bottom ends of the respective leg, said longitudinal axes of said legs being extended generally perpendicular to said upper surface of said top grate;

each of said legs being telescopically extendible, and having upper and lower telescopic portions in a telescopic relationship with one another;

said bottom end of each of said legs having a foot for securing to the bin floor;

an actuator being provided in each of said legs, each actuator being extendable in a direction parallel to the longitudinal axis of the associated leg, each actuator extending the associated leg for thrusting the plurality spikes into any caked grain located above and adjacent to the opening in the bin floor; and each actuator having a connector for permitting fluidic connection to a compressor, said connector being located in said foot of the associated leg.

9. A system for breaking apart caked grain in storage bin, comprising: a bin housing, a base floor, a bin floor for supporting grain in the storage bin spaced above the base floor, a conveyor located between the base floor and the bin floor for discharging grain from the storage bin, and an opening through the bin floor for feeding grain in the storage bin to the conveyor;

a caked grain breaking device comprising:

a top grate positioned above the opening in the bin floor, said top grate having upper and lower faces, and an outer perimeter, said upper and lower faces having a substantially horizontal orientation, a plurality of apertures extending through said top grate between said upper and lower faces to permit passage of grain through said top grate;

a plurality of spikes for breaking apart caked grain located above the opening in the bin floor, said plurality of spikes extending upwardly from said upper surface of said top grate;

a plurality of legs downwardly depending from said top grate and supporting said top grate above the bin floor, said legs being adapted for positioning around the opening in the bin floor;

each of said legs having a longitudinal axis and being telescopically extendible; and an actuator being provided in each of said legs, each fluidic piston-cylinder actuator extending the associated leg for thrusting the plurality of spikes into any caked grain located above and adjacent to the opening in the bin floor.

* * * * *